US008594532B2

(12) United States Patent
Cook et al.

(10) Patent No.: US 8,594,532 B2
(45) Date of Patent: Nov. 26, 2013

(54) DOOR DAMPENING DEVICE AND SYSTEM

(75) Inventors: Brian Dale Cook, Nicholasville, KY (US); Ian Froi Garcia Divinagracia, Cebu (PH)

(73) Assignee: Lexmark International, Inc., Lexington, KY (US)

( * ) Notice: Subject to any disclaimer, the term of this patent is extended or adjusted under 35 U.S.C. 154(b) by 0 days.

(21) Appl. No.: 13/306,559

(22) Filed: Nov. 29, 2011

(65) Prior Publication Data

US 2013/0000207 A1 Jan. 3, 2013

Related U.S. Application Data

(60) Provisional application No. 61/503,390, filed on Jun. 30, 2011.

(51) Int. Cl.
*E05F 5/02* (2006.01)
*E06B 7/28* (2006.01)

(52) U.S. Cl.
USPC ..... 399/124; 399/125

(58) Field of Classification Search
USPC ..... 49/386; 399/124, 125
See application file for complete search history.

(56) References Cited

U.S. PATENT DOCUMENTS 4,588,054 A * 5/1986 LeBaron ..... 188/280
4,641,947 A * 2/1987 Ishida et al. ..... 399/125
4,764,788 A * 8/1988 Watashi et al. ..... 399/214
5,206,681 A * 4/1993 Otomo et al. ..... 399/411
5,300,998 A * 4/1994 Ogisawa et al. ..... 399/124
5,614,997 A * 3/1997 Marumoto ..... 399/121
5,689,775 A * 11/1997 Marumoto ..... 399/121
5,995,784 A * 11/1999 Tempaku ..... 399/125
5,999,772 A * 12/1999 Kakitani et al. ..... 399/125
6,122,466 A * 9/2000 Aoki et al. ..... 399/125
6,588,555 B2 * 7/2003 Rottenberger et al. ..... 188/285
6,741,820 B2 * 5/2004 Nobe et al. ..... 399/110
6,993,268 B2 * 1/2006 Otaka ..... 399/124
7,133,626 B2 * 11/2006 Kaiga et al. ..... 399/110
7,228,949 B2 * 6/2007 Namiki et al. ..... 188/381
7,343,118 B2 * 3/2008 Ahn et al. ..... 399/124
7,369,794 B2 * 5/2008 Kawai et al. ..... 399/125
7,421,228 B2 * 9/2008 Tomura ..... 399/118
7,433,629 B2 * 10/2008 Tomatsu ..... 399/125
7,447,466 B2 * 11/2008 Ikebata ..... 399/110
7,515,849 B2 * 4/2009 Iketani ..... 399/124
7,680,431 B2 * 3/2010 Ikebata ..... 399/107
7,684,731 B2 * 3/2010 Hirose et al. ..... 399/124
7,747,196 B2 * 6/2010 Nobuoka et al. ..... 399/124
7,751,751 B2 * 7/2010 Ohta et al. ..... 399/125
7,764,905 B2 * 7/2010 Ohta et al. ..... 399/125

(Continued)

*Primary Examiner* — Katherine Mitchell
*Assistant Examiner* — Justin Rephann

(57) ABSTRACT

A device for attenuating movement of a door includes a housing having a first surface spaced apart from a second surface for defining a sliding path for an elongated sliding member. The elongated sliding member engages with at least one of the first and second surfaces when the elongated member slides in a first direction. A connecting member having a first end connected to the door and the other end to the elongated sliding member is provided so that opening of the door moves the sliding member in the first direction. Damping material is disposed between the elongated sliding member and at least one of the first and second surfaces. The damping material applies surface tension forces to the elongated sliding member when sliding in the first direction such that movement of the door attenuates or dampens the movement of the door.

21 Claims, 8 Drawing Sheets

(56) References Cited

U.S. PATENT DOCUMENTS

| | | | | |
|---|---|---|---|---|
| 7,769,322 | B2 * | 8/2010 | Ishihara et al. | 399/125 |
| 7,778,572 | B2 * | 8/2010 | Iijima | 399/125 |
| 7,804,628 | B2 * | 9/2010 | Hashimoto et al. | 358/494 |
| 7,822,362 | B2 * | 10/2010 | Watanabe et al. | 399/125 |
| 7,873,303 | B2 * | 1/2011 | Ohta et al. | 399/125 |
| 7,957,675 | B2 * | 6/2011 | Iijima | 399/125 |
| 7,991,325 | B2 * | 8/2011 | Yamaguchi | 399/125 |
| 8,023,859 | B2 * | 9/2011 | Matsumoto | 399/110 |
| 8,208,834 | B2 * | 6/2012 | Yamaguchi | 399/125 |
| 2002/0041775 | A1 * | 4/2002 | Ishii | 399/124 |
| 2005/0036804 | A1 * | 2/2005 | Yokoi | 399/124 |
| 2006/0083547 | A1 * | 4/2006 | Otaka | 399/124 |
| 2006/0099008 | A1 * | 5/2006 | Kurita | 399/110 |
| 2006/0104665 | A1 * | 5/2006 | Koshida | 399/124 |
| 2006/0120756 | A1 * | 6/2006 | Ahn et al. | 399/124 |
| 2006/0171740 | A1 * | 8/2006 | Ogawa | 399/124 |
| 2006/0239715 | A1 * | 10/2006 | Lee et al. | 399/122 |
| 2006/0285881 | A1 * | 12/2006 | Ahl et al. | 399/124 |
| 2007/0196128 | A1 * | 8/2007 | Ishihara et al. | 399/125 |
| 2008/0063430 | A1 * | 3/2008 | Nobuoka et al. | 399/124 |
| 2008/0066385 | A1 * | 3/2008 | Roach | 49/386 |
| 2008/0107446 | A1 * | 5/2008 | Ohtsuki | 399/124 |
| 2008/0131164 | A1 * | 6/2008 | Ohta et al. | 399/125 |
| 2008/0175620 | A1 * | 7/2008 | Ohta et al. | 399/125 |
| 2009/0079215 | A1 * | 3/2009 | Shirase | 296/37.12 |
| 2010/0158567 | A1 * | 6/2010 | Jeon | 399/124 |
| 2010/0278557 | A1 * | 11/2010 | Somemiya et al. | 399/124 |
| 2011/0243608 | A1 * | 10/2011 | Nishimura et al. | 399/125 |

* cited by examiner

DOOR DAMPENING DEVICE AND SYSTEM

CROSS REFERENCES TO RELATED APPLICATIONS

Pursuant to 35 U.S.C. 119, this application is related to and claims the benefit of the earlier filing date of provisional application having Ser. No. 61/503,390, filed on Jun. 30, 2011, and entitled "Door Dampening Device and System," the contents of which are hereby incorporated by reference herein in its entirety.

BACKGROUND

1. Field of the Invention

The present invention relates generally to doors and door closure apparatus and, more particularly, to a device for dampening the swinging open of a door using a linear slider.

2. Description of the Related Art

Doors or access covers, particularly those that are vertically mounted, typically lend themselves to being opened rapidly due to their weight and gravity. For example, when a user opens the door to access the interior of a machine and the user does not support the door through its rotation to the fully opened position, the tendency is for the door to swing open quickly. This may cause a shock load that can damage the hinge and/or the door itself. Also, an abruptly opening door gives an undesirable impression to the user that the product is cheap or of poor quality. Consequently, various damping devices have been constructed for attenuating the swinging open of a door. Some of the more common devices used to attenuate the rotational movement of a door use a torsional spring that is connected to the hinge and that provides a damping force when the door is opened or closed. Another common door damping device is a door engaging with a rack gear that attenuates the rotational movement of the door. However, such devices do not lend themselves especially useful in applications that have a small space to accommodate the damping device. If they are to be used, the footprint size of the product would increase which consequently contributes to additional cost to make the product.

Based upon the foregoing, there is a need to provide a reliable damping device for attenuating the swinging motion of a door that is compact, simple in design and inexpensive to manufacture.

SUMMARY

Example embodiments of the disclosure provide a device for attenuating movement of a door from a closed position to an open position. According to example embodiments, a housing having a first surface spaced apart from a second surface is provided to define a sliding path for an elongated sliding member. The elongated sliding member engages, such as frictionally engages, with at least one of the first surface and the second surface when the elongated member undergoes sliding movement in a first direction. A connecting member having one end thereof connected to the door and the other end to the elongated sliding member is provided so that opening of the door moves the sliding member in the first direction. Damping material is disposed between the at least one of the first surface and the second surface and the elongated sliding member. The damping material applies surface tension forces to the elongated sliding member when sliding in the first direction such that movement of the door from the closed position to the open position is attenuated or dampened.

BRIEF DESCRIPTION OF THE DRAWINGS

The above-mentioned and other features and advantages of the various embodiments of the invention, and the manner of attaining them, will become more apparent and will be better understood by reference to the accompanying drawings, wherein.

DETAILED DESCRIPTION

Figure 1A:
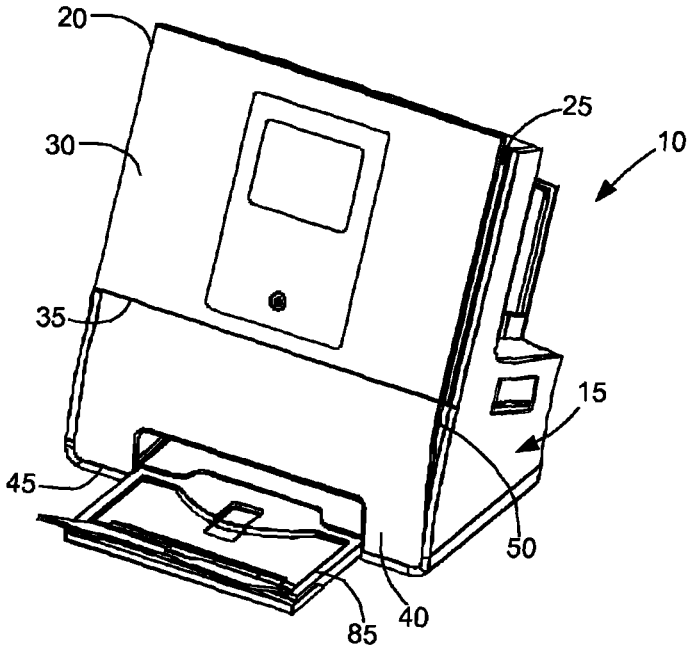
FIG. 1A is a perspective view of an embodiment of an imaging device with its access door in the closed position.

It is to be understood that the invention is not limited in its application to the details of construction and the arrangement of components set forth in the following description or illustrated in the drawings. The invention is capable of other embodiments and of being practiced or of being carried out in various ways. Also, it is to be understood that the phraseology and terminology used herein is for the purpose of description and should not be regarded as limiting. The use of "including," "comprising," or "having" and variations thereof herein is meant to encompass the items listed thereafter and equivalents thereof as well as additional items. Further, the terms "a" and "an" herein do not denote a limitation of quantity, but rather denote the presence of at least one of the referenced item.

Reference will now be made in detail to the example embodiments, as illustrated in the accompanying drawings. Whenever possible, the same reference numerals will be used throughout the drawings to refer to the same or like parts.

Figure 1B:
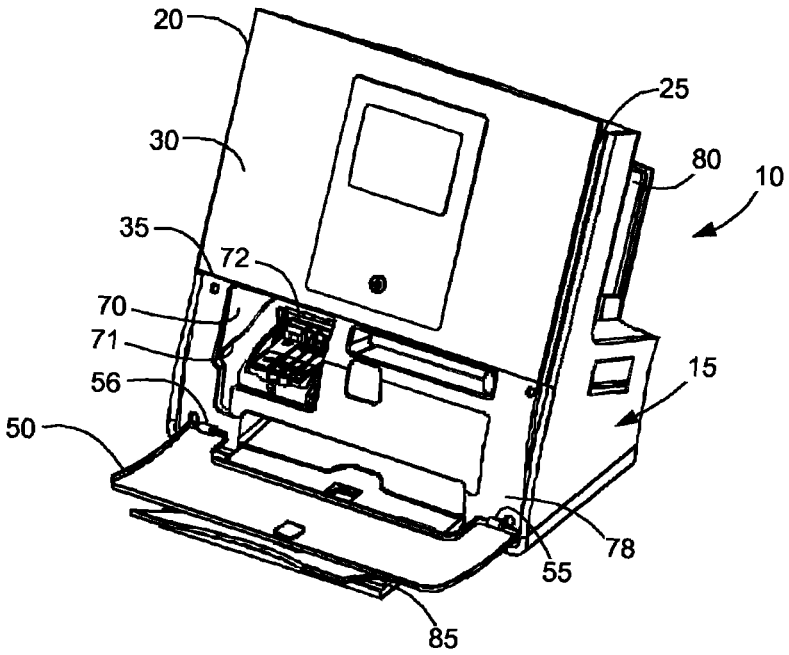
FIG. 1B is a perspective view of the embodiment of an imaging device of FIG. 1B with the access door in the open position.

FIGS. 1A and 1B illustrate a perspective view of an imaging device 10 embodying an example embodiment. Imaging device 10, which may be a standalone imaging device, includes a housing 15 having an upper front portion 20 including an image capture window 25. Image capture window 25 may be constructed from a rigid, transparent and/or translucent material, such as glass. Lid 30 may be pivotably connected along a bottom edge 35 thereof to the housing 15 via hinges or the like (not shown) to allow the lid 30 to swing relative to the image capture window 25 so that the lid 30 may cover the image capture window 25 in a closed position and uncover the image capture window 25 in an open position. FIGS. 1A and 1B illustrate lid 30 disposed in the closed position.

As shown, imaging device 10 may include an access cover 50 pivotably connected to a lower front portion 40 of the housing 15. The access cover 50 may be pivotably connected along a bottom edge 45 thereof to the lower front portion 40 of the housing 15 via hinges 55, 56, or the like to allow the access cover 50 to swing relative to the lower front portion 40 so that the access cover 50 may cover an interior 70 in a closed position and uncover the interior 70 in an open position. FIG. 1A illustrates the access cover 50 disposed in the closed position and FIG. 1B illustrates the access cover 50 in the open position.

According to an example embodiment, upper and lower front portions 20, 40 may be disposed in an inclined position at an acute angle relative to the horizontal. The back portion of the imaging device 10 may have an input media tray 80 that may retain one or more print media sheets therein. A media output area 85 may be positioned along a lower part of lower front portion 40.

As illustrated in FIG. 1B, according to an example embodiment the access cover 50 may be opened to access a tank install area 71 and to access a secondary cover 78 for removing jammed sheets of media and removing and installing a printhead. An ink tank assembly 72 having a plurality of ink cartridges as well as a printhead assembly (not shown) may be in tank install area 71.

Figure 2B:
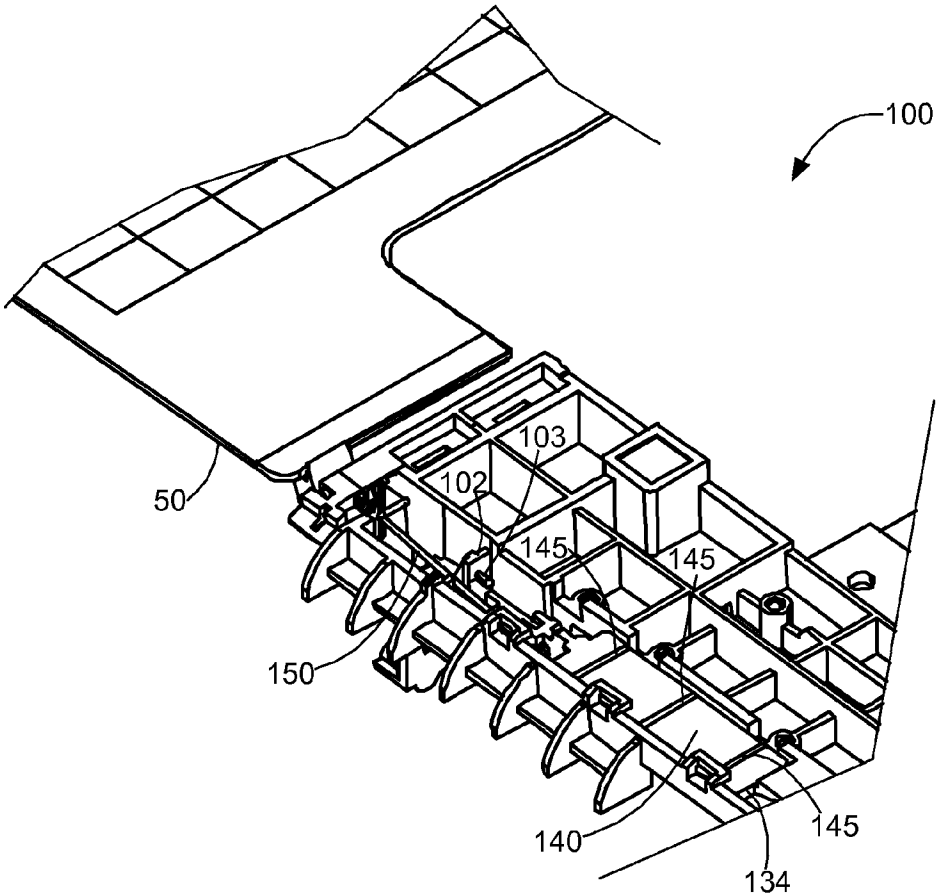
FIG. 2B is a perspective underside view of a corner, front portion of the imaging device of FIG. 1B with the slide cover and the biasing member removed.
Figure 2A:
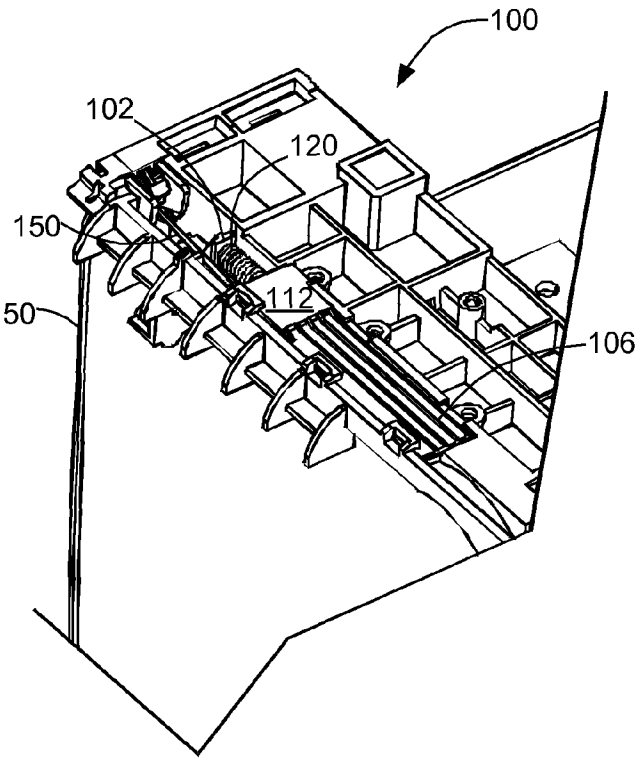
FIG. 2A is a perspective underside view of a corner, front portion of the imaging device of FIG. 1A.

FIGS. 2A and 2B show perspective underside views of a lower, corner portion of the access cover 50 and the base frame assembly 100 of the imaging device 10. Base frame assembly 100 includes a housing 112 and an attenuating device 110 for dampening the rotational movement of the access cover 50 as it moves from the closed position (as shown in FIG. 1A) to the open position (as shown in FIG. 1B). Attenuating device 110 may include elongated sliding member 130 (FIG. 2B) disposed within housing 112 and operatively coupled to the access cover 50 so as to undergo substantially linear sliding movement in a forward direction (i.e., towards the front of imaging device 10) during movement of the access cover 50 from the closed position to the open position, and movement in a direction opposite the first direction when access cover 50 is moved from the open position to the closed position. Housing 112 may include a floor portion 106 (shown in FIG. 2A, whereas FIG. 2B shows base frame assembly without floor portion 106 so as to illustrate the positioning of sliding member 130) having an inner surface for engaging with sliding member 130, creating surface tension forces acting thereon and resisting movement of sliding member 130 in the forward direction.

Figure 5:
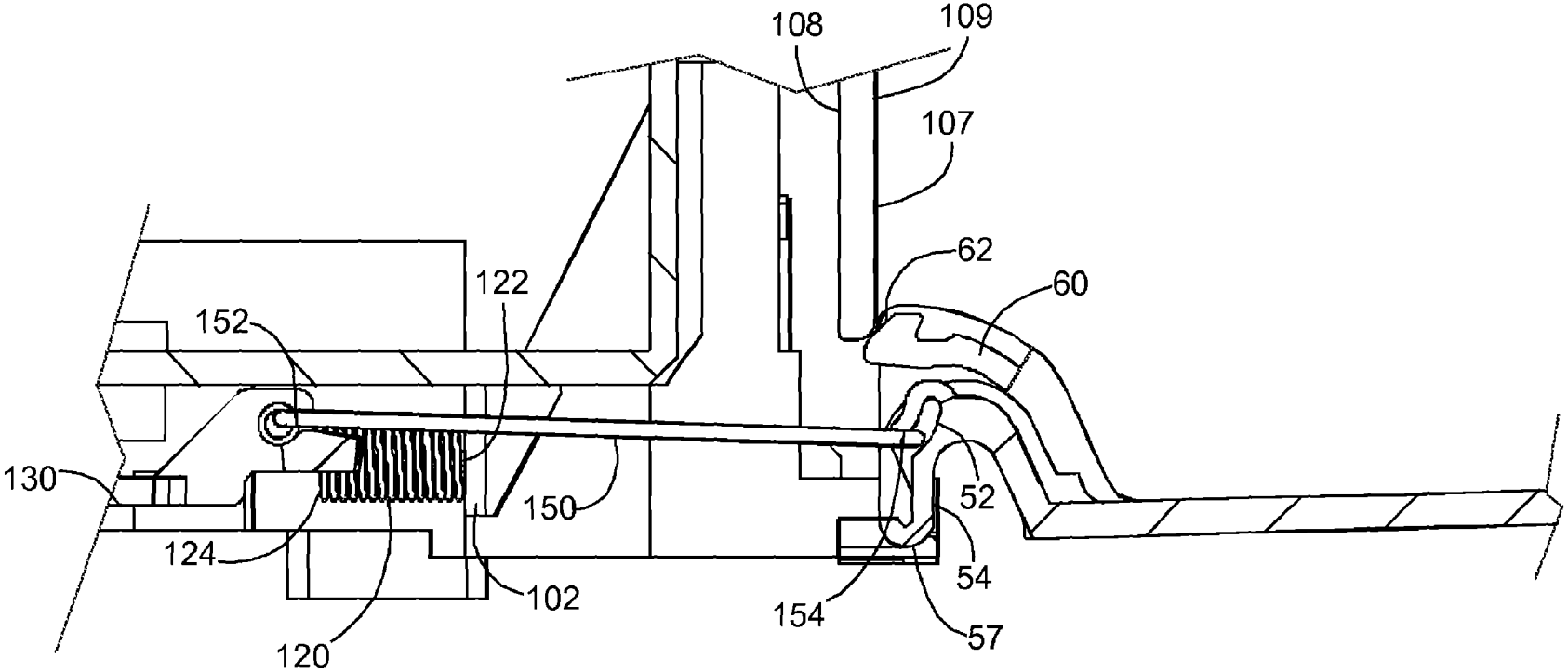
FIG. 5 is a side section view of a portion of the access door and base frame assembly of the imaging device of FIGS. 1A and 1B with the access door in the open position.
Figure 8:
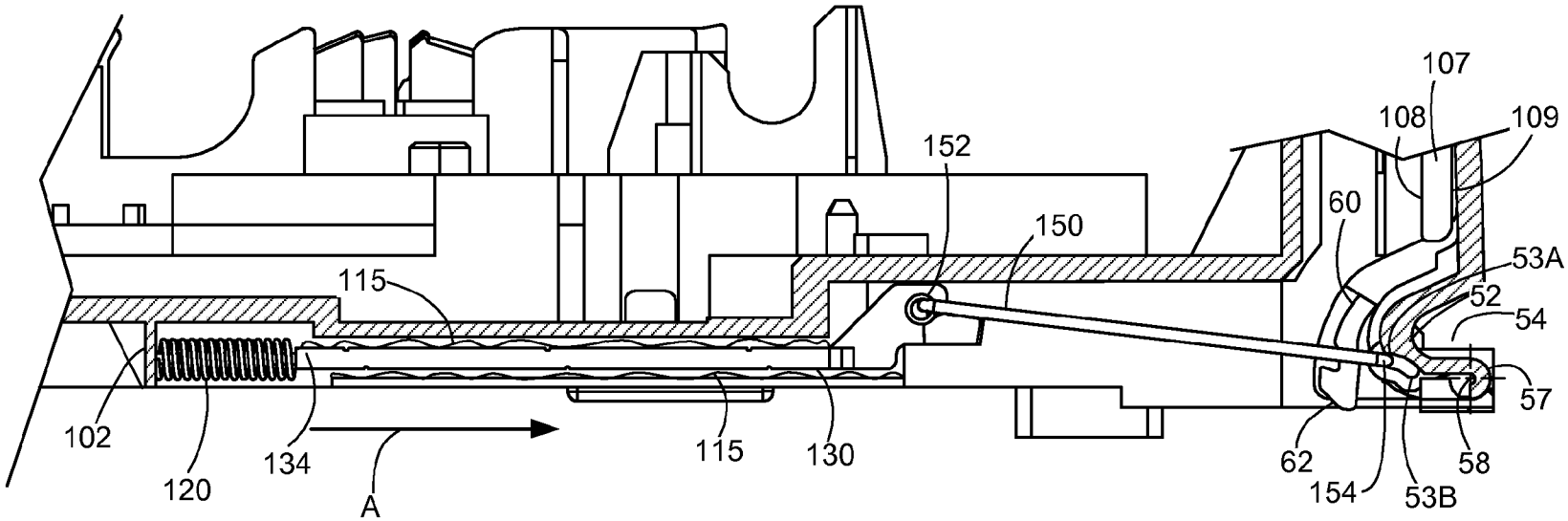
FIG. 8 is a side section view of a portion of the access door and base frame assembly of the imaging device of FIGS. 1A and 1B with the access door in the closed position, according to another example embodiment.

Attenuating device 110 may further include a biasing member 120 which may further resist the forward movement of the elongated sliding member 130. In one example embodiment as depicted in FIG. 2A, the biasing member 120 may be a compression spring having a first end 122 (FIG. 5) receivably mounted to a post 103 (FIG. 2B, which shows post 103 with biasing member 120 removed) extending from a wall 102 positioned forwardly of sliding member 130, and a second end 124 (FIG. 5) receivably mounted to a post 133 on a front end 132 of the elongated sliding member 130 (best seen in FIG. 3). In another contemplated embodiment shown in FIG. 8, the biasing member 120 may be a tension spring positioned rearwardly of the sliding member 130, having one end connected to a rear end 134 of the elongated sliding member 130 and a second end to a wall 102. Like biasing member 120, the tension spring provides resistance against the movement of the elongated sliding member 130 in the forward direction.

Housing 112, which may form an enclosure at least partly around sliding member 130, may include the floor portion 106 fixably mounted by appropriate fastening means such as screws, on the base frame assembly 100. Housing 112 provides a space between the floor portion 106 and the base frame assembly 100 to accommodate the elongated sliding member 130 at least partly therein. Elongated sliding member 130 of attenuating device 110 may be positioned above floor portion 106, as indicated in FIG. 4.

Figure 3:
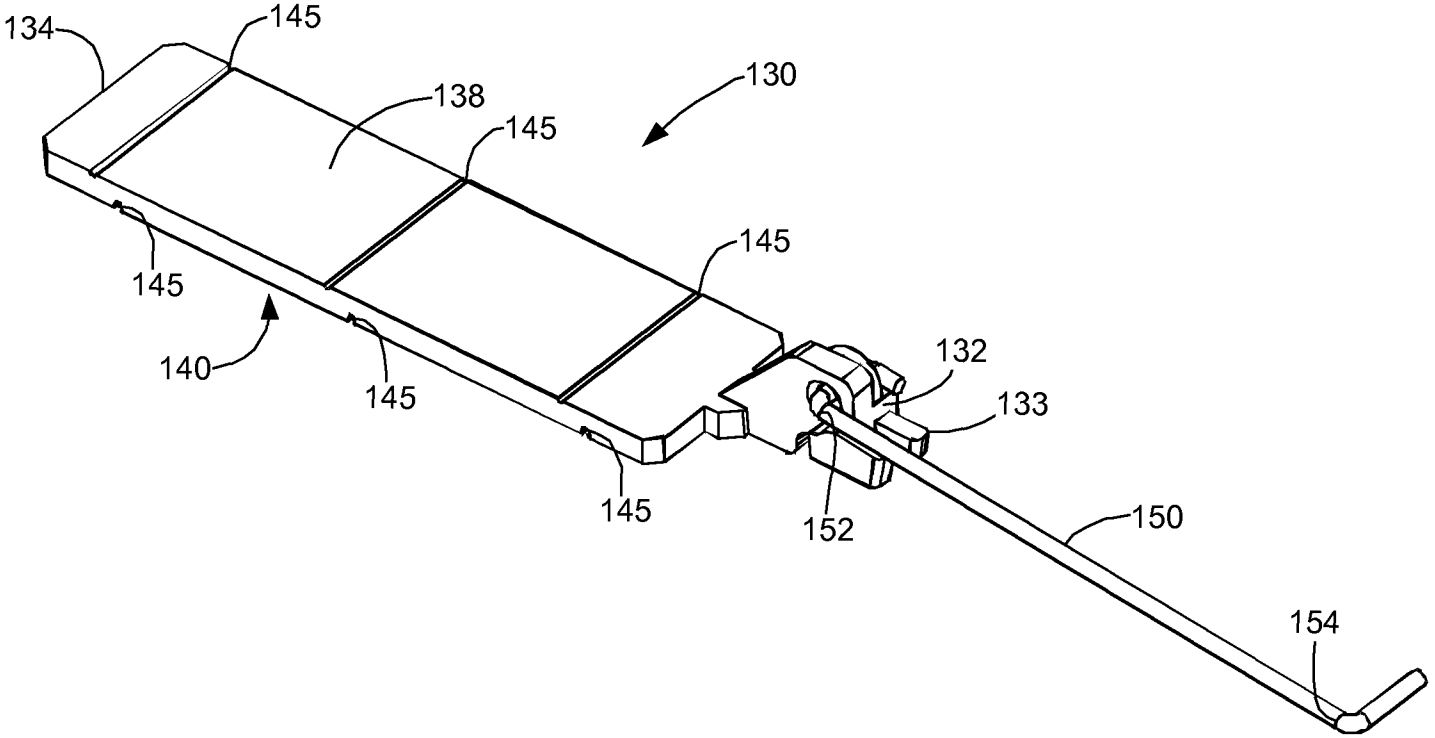
FIG. 3 is a perspective view of the dampening assembly of FIGS. 2A and 2B.
Figure 4:
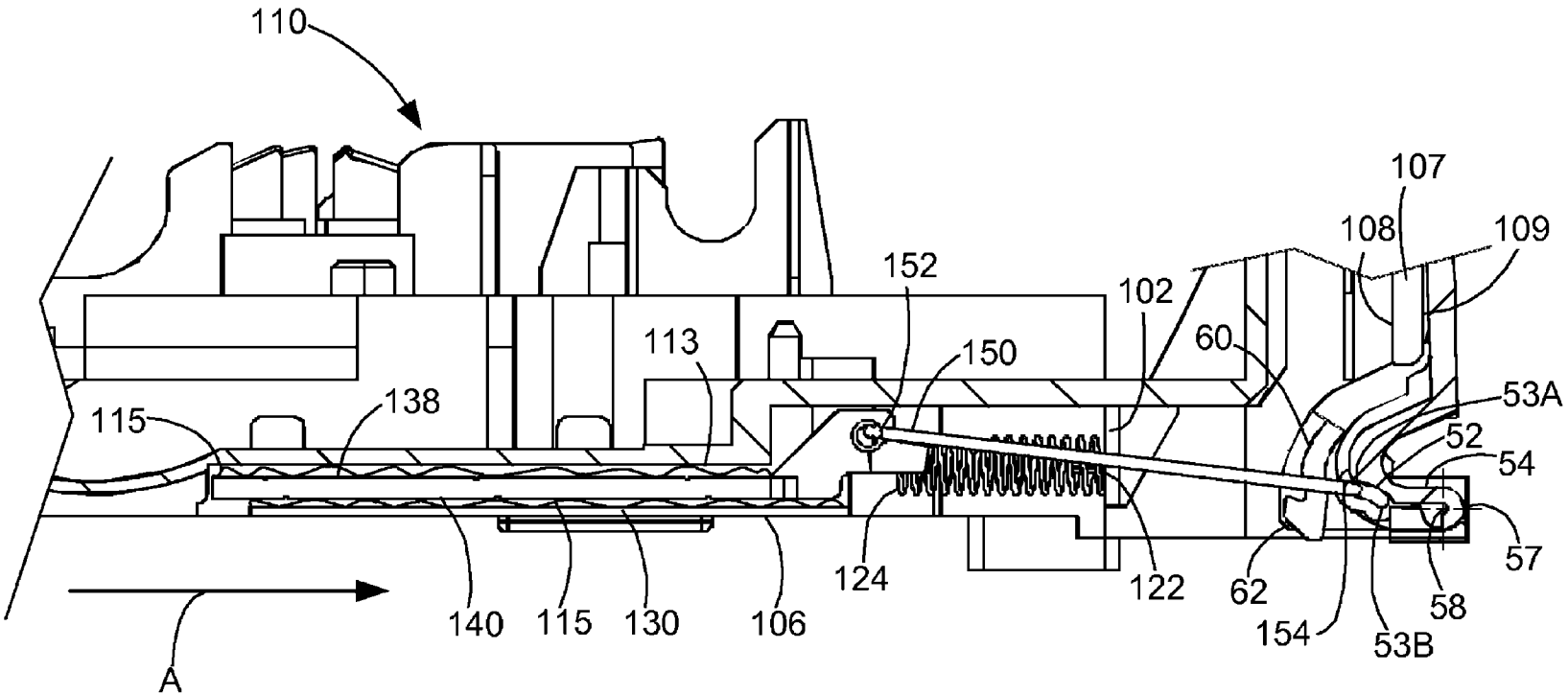
FIG. 4 is a side section view of a portion of the access door and base frame assembly of the imaging device of FIGS. 1A and 1B with the access door in the closed position.

Attenuating device 110 may further include connecting member 150 having a front end 152 coupled to front end 132 of elongated sliding member 130 and a rear end 154 coupled to the access cover 50 (FIG. 4). In one example embodiment, the connecting member 150 may be a substantially rigid wire form made of stainless steel material or like material. Each end 152, 154 of the connecting member 150 may have a hook portion. As shown in FIG. 3, the hook portion of front end 152 may be received in the aperture at front end 132 of the elongated sliding member 130 such that the hook portion of front end 152 straddles and prevents withdrawal of the connecting member 150 and disconnection from the aperture of the front end 132 of the elongated sliding member 130. Similarly, the hook portion of rear end 154 is received in an arcuate slot 52 at the pivoting end 54 of the access cover 50 (FIGS. 4 and 5) such that the hook portion of rear end 154 prevents withdrawal of the connecting member 150 and disconnection from the arcuate slot 52.

Referring to FIG. 4, a layer of damping grease 115 may be provided in the gap between the engaging surface of the ceiling portion 113 of housing 112 and the upper contacting surface 138 of the elongated sliding member 130, and/or in the gap between the lower contacting surface 140 of the elongated sliding member 130 and the floor portion 106. In an example embodiment, damping grease 115 is a fluorocarbon gel, such as fluorocarbon gel 868VH made by Nye Lubricants, Inc. of Fairhaven, Mass. It is understood, however, that damping grease 115 may be other lubricants or fluorocarbon gels. As shown in FIG. 3, the elongated sliding member 130, in one embodiment, may have a plurality of grooves 145 formed laterally across the upper contacting surface 138 and/or the lower contacting surface 140 of sliding member 130. Grooves 145 serve to retain damping grease 115 therein. In an alternative embodiment, a plurality of grooves (not shown) may be formed laterally across the engaging surface of the floor portion 106 and/or the engaging surface of the base frame assembly 100. Though grooves 145 are depicted in FIG. 3 as being substantially linear and laterally disposed across upper contacting surface 138, it is understood that grooves 145 may have any of a number of different shapes so long as such shaped grooves serve to retain damping grease 115.

It will be understood that, when the access cover 50 moves from the closed position (shown in FIG. 4) to the open position (FIG. 5), the rotation of cover 50 substantially about axis 58 pulls connecting member 150 forwardly toward a front of imaging device 10 such that the elongated sliding member 130 advances in the forward direction indicated by arrow A (shown in FIG. 4). However, the surface tension forces applied to sliding member 130 by floor portion 106 and/or base frame assembly 100, at least partly due to the presence of damping grease 115 as explained above, are sufficient to slow down or otherwise dampen the forward movement of the elongated sliding member 130, thereby damping or attenuating rotational movement of the access cover 50 to effectuate smooth and non-abrupt opening movement thereof. Further, as mentioned above, the biasing member 120 may also provide a force resisting the forward movement of elongated sliding member 130 which also serves to attenuate the forward movement of the elongated sliding member 130 and opening movement of access cover 50 in a substantially constant, non-abrupt, and smooth motion.

In one example embodiment, a breakaway feature is provided to at least partly relieve the stress at the pivoting member 57 of base frame assembly 100 when access cover 50 is fully opened. As can readily seen from comparing FIGS. 6A and 7B, the position of the hook portion of rear end 154 is in a first portion 53A of the arcuate slot 52 of the access cover 50. It will be understood, therefore, that from the closed position (shown in FIG. 7B) up to the time when the access cover 50 is rotated about 75 degrees from the vertical, the torque on the hinges 55, 56 (FIG. 1B) increases due to the unsupported weight of the access cover 50 and the spring force exerted by the biasing member 120. Furthermore, a user may accidentally force the access cover 50 to rotate beyond its intended operating window and/or beyond its intended, fully open position and could damage the hinges 55, 56 as a result.

Figure 6A:
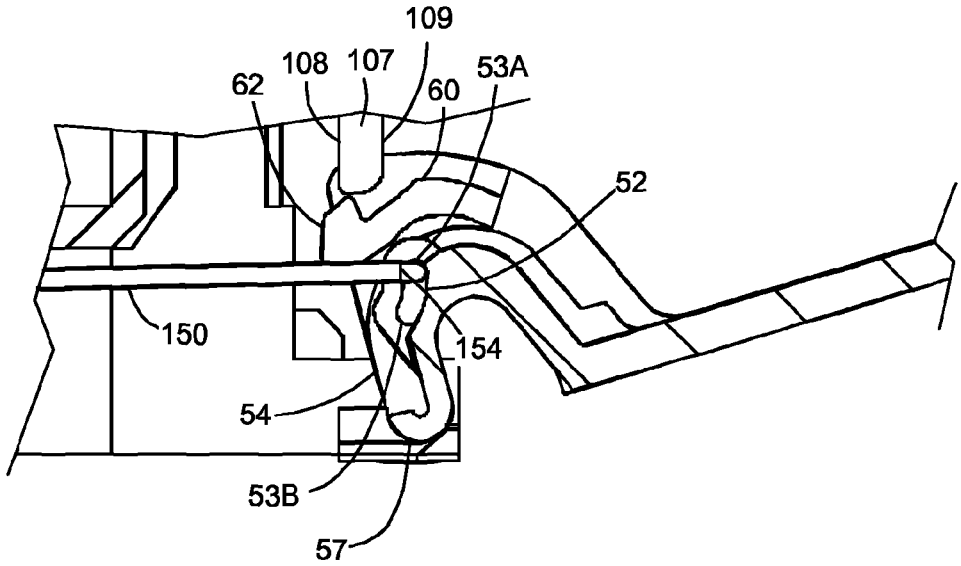
FIG. 6A is a side section view of a portion of the access door and base frame assembly of FIGS. 1A and 1B with the access door rotated about 75 degrees from the closed position.
Figure 6B:
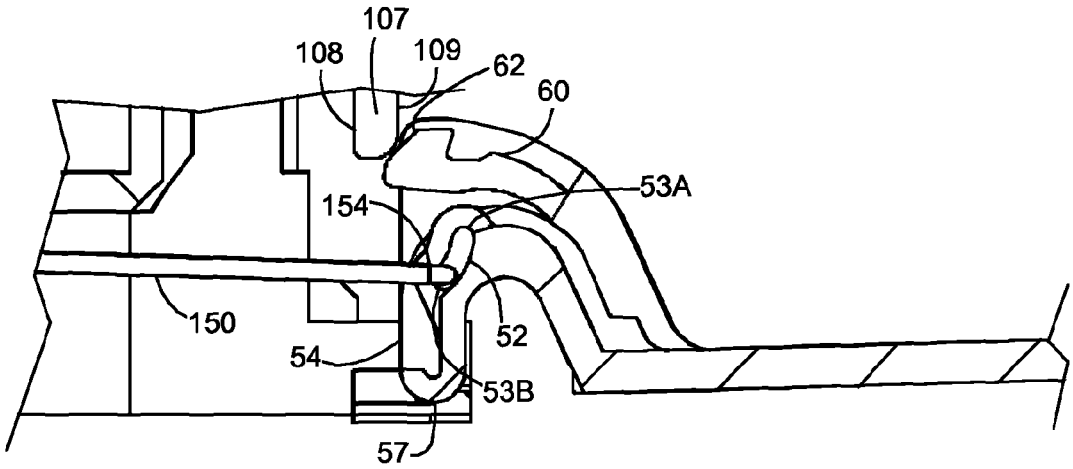
FIG. 6B is a side section view of a portion of the access door and base frame assembly of FIGS. 1A and 1B with the access door rotated about 90 degrees from the closed position.

The breakaway feature enables the access cover 50 to release at least some of the stress experienced by hinges 55, 56. As shown in FIG. 6A, when the door is opened about 75 degrees from the closed or substantially vertical position, the hook portion of rear end 154 of connecting member 150 is positioned to engage the first portion 53A of the arcuate slot 52. Access cover 50 is provided with a claw member 60 for engaging a wall portion 107 of base frame assembly 100. At an opening of about 75 degrees, the claw member 60 flexes as it moves against the wall portion 107 from the rear side 108 until the claw member 60 eases out of the front side 109 of wall portion 107 at an opening of about 90 degrees (FIG. 6B). As the claw member 60 eases out of engagement with the wall portion 107, the claw member 60 springs back or otherwise resiliently returns to its original form such that an edge surface 62 of the claw member 60 abuts against the front side 109 of wall portion 107. The springing, resilient action of the claw member 60 causes movement of the hook portion 156 of rear end 154 to move from the first portion 53A to the second portion 53B of the arcuate slot 52 as shown in FIG. 6B. As a result, some of the stress on the hinges 55, 56 is released by allowing the biasing member 120 to decompress.

Figure 7A:
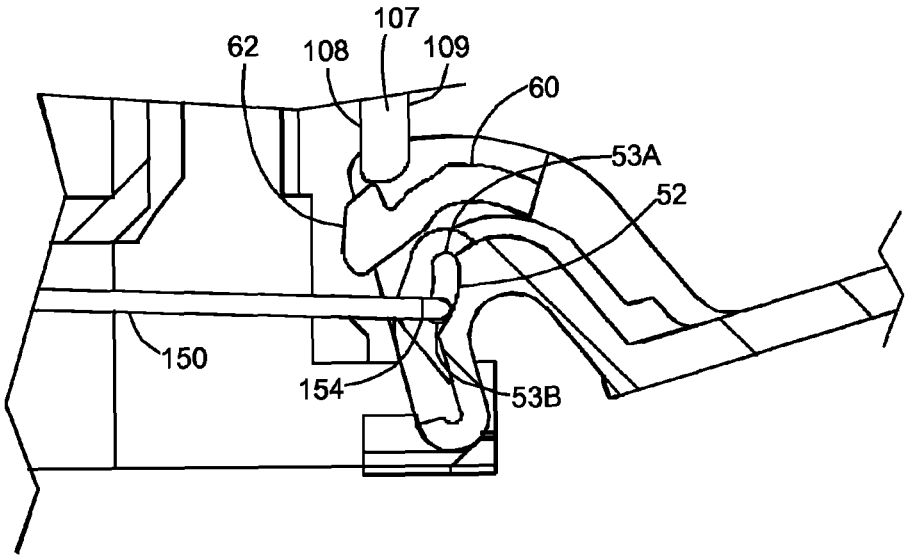
FIG. 7A is a side section view of a portion of the access door and base frame assembly with the access door rotated about 15 degrees from the open position.
Figure 7B:
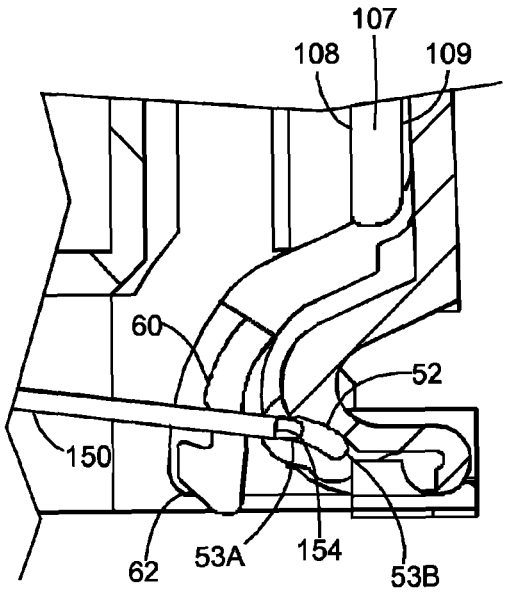
FIG. 7B is a side section view of a portion of the access door and base frame assembly with the access door rotated to the closed position.

To return the access cover 50 back to the closed position, the user applies a force to rotate the access cover 50, allowing the hook portion of rear end 154 to move from second portion 53B, as shown in FIG. 7A, back to the first portion 53A of the arcuate slot 52, as shown in FIG. 7B. Claw member 60 flexes back into engagement and then out of engagement with the wall 107 from the front side 109 to the rear side 108 until it reaches its original position. The rotational movement of the access cover 50 back to the closed position allows the biasing member 120 to decompress and to push the elongated sliding member 130 in the direction opposite arrow A. In an example embodiment, magnets (not shown) may be used to secure the access cover 50 in the closed position although latches or other mechanisms may be used.

The foregoing description of several methods and embodiments has been presented for purposes of illustration. It is not intended to be exhaustive or to limit the invention to the precise acts and/or forms disclosed, and obviously many modifications and variations are possible in light of the above teaching. It is intended that the scope of the invention be defined by the claims appended hereto.

What is claimed is:

1. A device for attenuating movement of a door, comprising:

a housing having a first surface and a second surface, the first surface of the housing spaced apart from the second surface of the housing;

an elongated sliding member coupled to the door and disposed between the first surface and the second surface of the housing, the elongated sliding member having at least one surface slidingly engaging at least one of the first surface and the second surface of the housing when the elongated sliding member slides in a first direction; and a damping material disposed between the at least one surface of the elongated sliding member and the at least one of the first surface and the second surface of the housing, the damping material comprising at least one of a grease and a gel for applying surface forces to the elongated sliding member when sliding in the first direction and attenuating sliding movement thereof;

wherein the movement of the door causes movement of the elongated sliding member in the first direction, the movement of the elongated sliding member in the first direction attenuating the movement of the door;

wherein the elongated sliding member comprises a groove formed on the at least one surface of the elongated sliding member, the groove being adjacent to and facing the at least one of the first surface and the second surface of the housing and retaining the damping material therein, the at least one surface of the elongated sliding member being disposed adjacent to and facing the at least one of the first surface and the second surface of the housing.

2. The device of claim 1, further comprising a connecting member having a first end connected to the door and a second end connected to the elongated sliding member.

3. The device of claim 2, wherein the connecting member is a wire.

4. The device of claim 2, wherein the door comprises an arcuate slot having a first portion and a second portion formed near a pivoting end of the door, the arcuate slot receiving the first end of the connecting member, wherein during movement of the door from an open position to a closed position, the first end of the connecting member moves from the first portion to the second portion of the arcuate slot, and during movement of the door from the closed position to the open position the first end of the connecting member moves from the second portion to the first portion of the arcuate slot.

5. The device of claim 1, further comprising a biasing member having a first end attached to the elongated sliding member and a second end attached to the housing, the biasing member providing a resisting force to the sliding of the elongated sliding member in the first direction.

6. The device of claim 5, wherein the biasing member is a compression spring mounted to a front end of the elongated sliding member.

7. The device of claim 5, wherein the biasing member is a tension spring mounted to a rear end of the elongated sliding member.

8. A door assembly, comprising:

a door;

a housing having a first surface and a second surface, the first surface of the housing spaced apart from the second surface of the housing;

an elongated sliding member coupled to the door and disposed between the first surface and the second surface of the housing, a first surface of the elongated sliding member slidingly engaging at least one of the first surface and the second surface when the elongated sliding member slides in a first direction; and a damping material disposed between the first surface of the elongated sliding member and the at least one of the first surface and the second surface of the housing, the damping material applying surface forces to the first surface of the elongated sliding member when sliding in the first direction and attenuating sliding movement thereof;

wherein the movement of the door causes movement of the elongated sliding member in the first direction, the movement of the elongated sliding member in the first direction attenuating the movement of the door;

wherein the elongated sliding member comprises a groove formed on the first surface of the elongated sliding member, the groove facing the at least one of the first surface and the second surface of the housing and retaining the damping material therein, the first surface of the elongated sliding member being disposed adjacent to and facing the at least one of the first surface and the second surface of the housing.

9. The door assembly of claim 8, further comprising a connecting member having a first end connected to the door and a second end connected to the elongated sliding member.

10. The door assembly of claim 9, wherein the connecting member is a wire.

11. The door assembly of claim 9, wherein the door comprises an arcuate slot having a first portion and a second portion formed near a pivoting end of the door, the arcuate slot receiving the first end of the connecting member, wherein during movement of the door from an open position to a closed position, the first end of the connecting member moves from the first portion to the second portion of the arcuate slot, and during movement of the door from the closed position to the open position the first end of the connecting member moves from the second portion to the first portion of the arcuate slot.

12. The door assembly of claim 8, wherein the door further comprises a claw member formed near the pivoting end of the door, the claw member having a first surface and a second surface, wherein during movement of the door from a closed position to an open position, the first surface of the claw member contacts and engages a rear side of a wall.

13. The door assembly of claim 12, wherein the claw member is constructed from a resilient material and is flexed and changes shape due to contact and engagement with the wall during movement of the door from the closed position to the open position before returning to an original shape upon the door being fully open, the original shape being a shape of the claw member when not flexed.

14. The door assembly of claim 12, wherein the second surface of the claw member abuts against a front side of the wall when the door is in the open position.

15. The door assembly of claim 8, further comprising a biasing member having a first end attached to the elongated sliding member and second end attached to a wall of the housing, the biasing member providing a resisting force to the sliding of the elongated sliding member in the first direction.

16. The door assembly of claim 15, wherein the biasing member is a compression spring mounted to a front end of the elongated sliding member.

17. The door assembly of claim 8, wherein the damping material comprises a grease or a gel.

18. A door assembly, comprising:

a door;

a housing having a first surface and a second surface, the first surface of the housing spaced apart from the second surface of the housing;

an elongated sliding member disposed between the first surface and the second surface of the housing, the elongated sliding member engaging at least one of the first surface and the second surface when the elongated sliding member slides in a first direction;

a damping material disposed between the elongated sliding member and at least one of the first surface and the second surface of the housing, the damping material applying surface forces to the elongated sliding member when sliding in the first direction;

wherein the movement of the door causes movement of the elongated sliding member in the first direction, the movement of the elongated sliding member in the first direction attenuating the movement of the door;

the door assembly further comprising a connecting member having a first end connected to the door and a second end connected to the elongated sliding member; and wherein the door comprises an arcuate slot having a first portion and a second portion formed near a pivoting end of the door, the arcuate slot receiving the first end of the connecting member, wherein during movement of the door from an open position to a closed position, the first end of the connecting member moves from the first portion to the second portion of the arcuate slot, and during movement of the door from the closed position to the open position the first end of the connecting member moves from the second portion to the first portion of the arcuate slot.

19. A door assembly, comprising:

a door;

a housing having a first surface and a second surface, the first surface of the housing spaced apart from the second surface of the housing;

an elongated sliding member disposed between the first surface and the second surface of the housing, the elongated sliding member engaging at least one of the first surface and the second surface when the elongated sliding member slides in a first direction;

a damping material disposed between the elongated sliding member and at least one of the first surface and the second surface of the housing, the damping material applying surface forces to the elongated sliding member when sliding in the first direction;

wherein the movement of the door causes movement of the elongated sliding member in the first direction, the movement of the elongated sliding member in the first direction attenuating the movement of the door;

wherein the door further comprises a claw member formed near the pivoting end of the door, the claw member having a first surface and a second surface, wherein during movement of the door from a closed position to an open position, the first surface of the claw member contacts and engages a rear side of a wall; and wherein the second surface of the claw member abuts against a front side of the wall when the door is in the open position.

20. A device for attenuating movement of a door:

a first surface and a second surface of a housing, the first surface of the housing spaced apart from the second surface of the housing;

an elongated sliding member disposed between the first surface and the second surface of the housing, the elongated sliding member engaging at least one of the first surface and the second surface when the elongated sliding member slides in a first direction; and a damping material disposed between the elongated sliding member and at least one of the first surface and the second surface, the damping material applying surface forces to the elongated sliding member when sliding in the first direction;

wherein the movement of the door causes movement of the elongated sliding member in the first direction, the movement of the elongated sliding member in the first direction attenuating the movement of the door;

the device further comprises a connecting member having a first end connected to the door and a second end connected to the elongated sliding member;

wherein the door comprises an arcuate slot having a first portion and a second portion formed near a pivoting end of the door, the arcuate slot receiving the first end of the connecting member, wherein during movement of the door from an open position to a closed position, the first end of the connecting member moves from the first portion to the second portion of the arcuate slot, and during movement of the door from the closed position to the open position the first end of the connecting member moves from the second portion to the first portion of the arcuate slot.

21. A door assembly, comprising:

a door;

a housing having a first surface and a second surface, the first surface of the housing spaced apart from the second surface of the housing;

an elongated sliding member coupled to the door and disposed between the first surface and the second surface of the housing, a first surface of the elongated sliding member slidingly engaging at least one of the first surface and the second surface when the elongated sliding member slides in a first direction; and a damping material disposed between the first surface of the elongated sliding member and the at least one of the first surface and the second surface of the housing, the damping material applying surface forces to the first surface of the elongated sliding member when sliding in the first direction and attenuating sliding movement thereof;

wherein the movement of the door causes movement of the elongated sliding member in the first direction, the movement of the elongated sliding member in the first direction attenuating the movement of the door;

wherein the door further comprises a claw member formed near the pivoting end of the door, the claw member having a first surface and a second surface, wherein during movement of the door from a closed position to an open position, the first surface of the claw member contacts and engages a rear side of a wall;

wherein the claw member is constructed from a resilient material and is flexed and changes shape due to contact and engagement with the wall during movement of the door from the closed position to the open position before returning to an original shape upon the door being fully open, the original shape being a shape of the claw member when not flexed.

* * * * *